United States Patent [19]

Combette et al.

[11] 4,119,257

[45] Oct. 10, 1978

[54] POWER ACTUATED TOOLS

[75] Inventors: Marc Combette; Jean Ollivier, both of Valence, France

[73] Assignee: Societe de Prospection et d'Inventions Techniques SPIT, Bourg-les-Valence, France

[21] Appl. No.: 820,191

[22] Filed: Jul. 29, 1977

Related U.S. Application Data

[63] Continuation of Ser. No. 698,633, Jun. 22, 1976, abandoned.

[30] Foreign Application Priority Data

Jul. 2, 1975 [FR] France ..... 75 20748

[51] Int. Cl.[2] ..... B25C 1/14

[52] U.S. Cl. ..... 227/10

[58] Field of Search ..... 227/8, 9, 10, 11

[56] References Cited

U.S. PATENT DOCUMENTS

| | | | |
|---|---|---|---|
| 2,765,464 | 10/1956 | Weichold | 227/10 |
| 2,801,416 | 8/1957 | Evans et al. | 227/9 |
| 3,204,400 | 9/1965 | Kuavle | 227/8 |
| 3,746,235 | 7/1973 | Crabtree, Jr. | 227/9 |
| 3,899,113 | 8/1975 | Brack | 227/10 |

*Primary Examiner*—Granville Y. Custer, Jr.
*Attorney, Agent, or Firm*—William W. Jones; Paul J. Lerner

[57] ABSTRACT

A power actuated tool comprising an expansion chamber for the combustion gases of a piece of ammunition placed in a combustion chamber.

In the tool at least one substantially radial through hole is provided in the wall of the expansion chamber or of the combustion chamber and a bush which moves relative to the chamber is provided so as to be able to more or less completely expose the hole.

10 Claims, 26 Drawing Figures

POWER ACTUATED TOOLS

This is a continuation, of application Ser. No. 698,633, filed June 22, 1976 now abandoned.

The present invention relates to improvements to a power actuated tool used for fixing a fastener in a hard wall, utilizing the combustion of a propulsive charge.

Tools of this type can be fired directly, i.e. the combustion gases act directly on the back surface of the fastener in order to propel the same. Indirect firing tools also exist in which a ram is placed between the charge and the fastener.

In both cases the propulsive charge can comprise ammunition having a case whose combustion gases expand in an expansion chamber provided between the ammunition and the rear of the fastener or the ram. It has also been proposed to use caseless agglomerated charges placed in a high pressure chamber where the ammunition burns, whereby the high pressure chamber is connected with a low pressure chamber provided between the ammunition recess and the rear face of the fastener or the ram.

In the case of all these different types of tools and ammunition it is desirable to be able to vary the firing power, particularly as a function of the hardness of the wall in which the fastener is to be introduced. It is obviously possible to use different ammunition types, but the power variations obtained are not very flexible and the operator must permanently have available ammunition with different power ratings.

It is also possible for the purpose of varying the power to modify the volume of the chamber in which the combustion gases expand, i.e. the expansion chamber in the case of a tool with cased ammunition and the low pressure chamber in the case of a tool with caseless ammunition. This latter solution is highly effective but leads to a considerable complication in the construction of the tool.

The present invention aims at permitting the easy variation within significant limits of the firing power of the tool using simple and more reliable means than those used hitherto.

To this end the invention has for its object a power actuated tool comprising an expansion chamber for the combustion gases of a piece of ammunition located in the combustion chamber, wherein at least one substantially radially through hole is provided in the wall of the expansion chamber or the combustion chamber and a bush which is movable relative to the chamber having the hole, so as to be able to expose more or less completely the hole.

To this end according to one embodiment the bush is equipped with at least one through hole.

The device according to the invention makes it possible to obtain a variable exhausting of combustion gases permitting the variation of the firing power from a minimum value to a maximum value.

According to one embodiment of the invention the bush is screwed to the barrel.

According to a variant the bush is fixed in translation relative to the barrel and rotates about the barrel axis.

According to another variant an independent ammunition holder can be provided which is supported on the free end of the bush, preferably the hole or holes are provided in a rear smaller diameter portion of the barrel, whereby the bush is screwed to a larger diameter portion of the barrel and has an internal shoulder arranged so that it can co-operate with the shoulder provided on the barrel between the smaller diameter portion and the larger diameter portion.

In the case of an exclusively rotary bush, it is advantageous for the bush to have an indexing means, for example, a ball returned by a spring and co-operating with recesses in a fixed portion adjacent to the tool.

According to one embodiment the hole or holes in the bush are flared whilst diverging from the axis.

According to a variant the bush has a plurality of holes in the same radial plane and having different diameters.

It is also desirable for the bush periphery to be at least partly vented.

The invention will be better understood from reading the following description with reference to the attached drawings in which.

Figure 10:
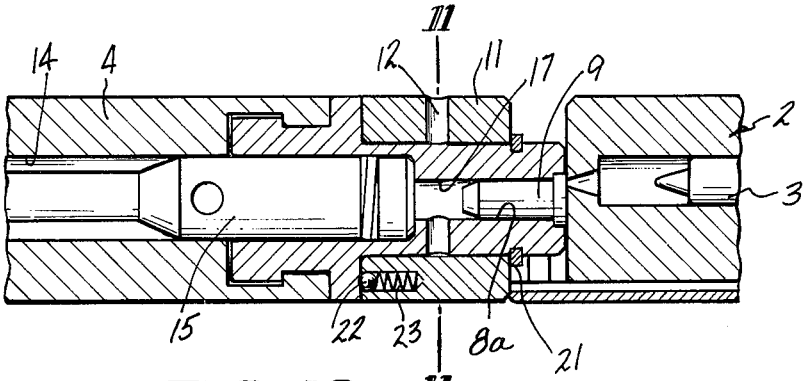
FIG. 10 shows in longitudinal section a further variant of the tool according to the invention.
Figure 11A:
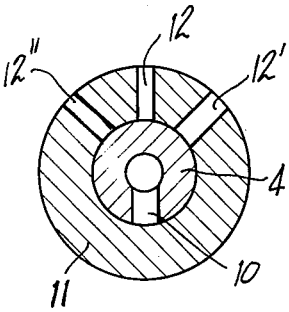
Figure 11B:
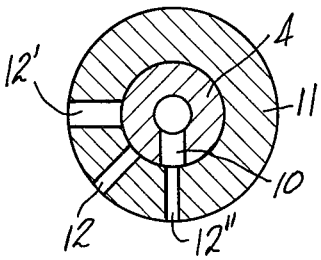
Figure 11C:
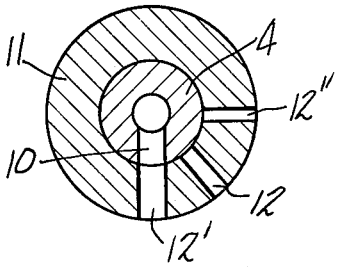
Figure 12:
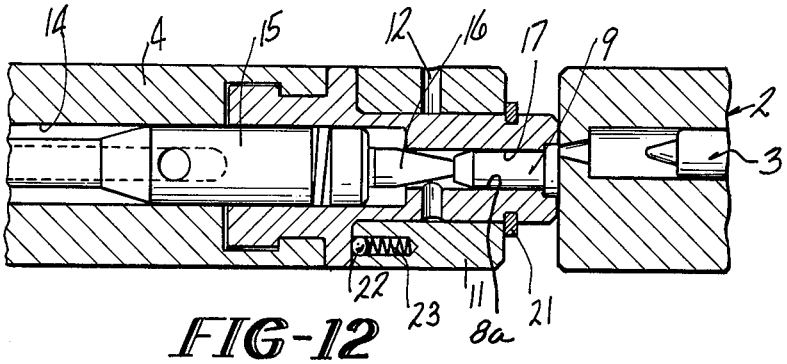
Figure 13:
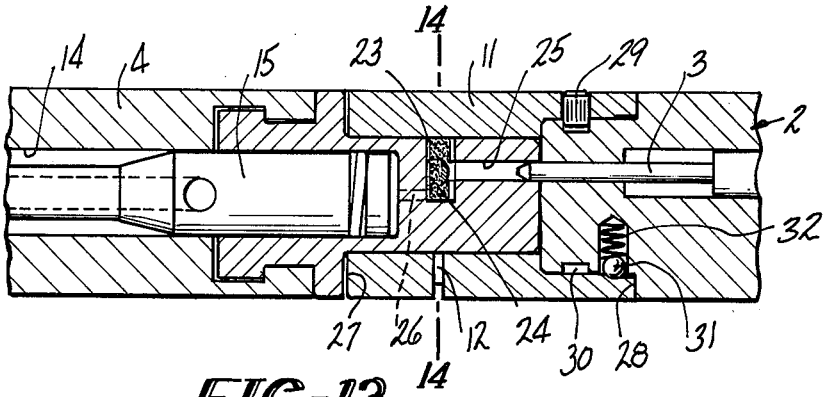
Figure 14A:
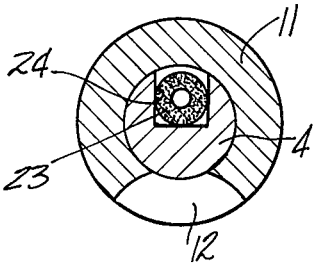
Figure 14B:
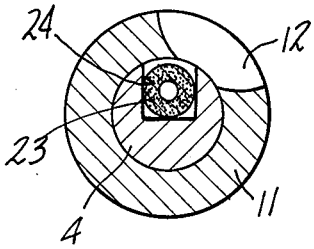
Figure 14C:
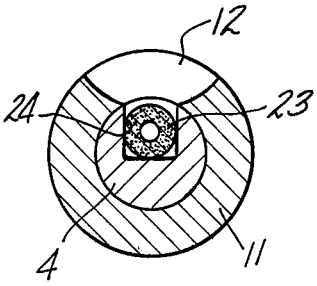
Figure 15:
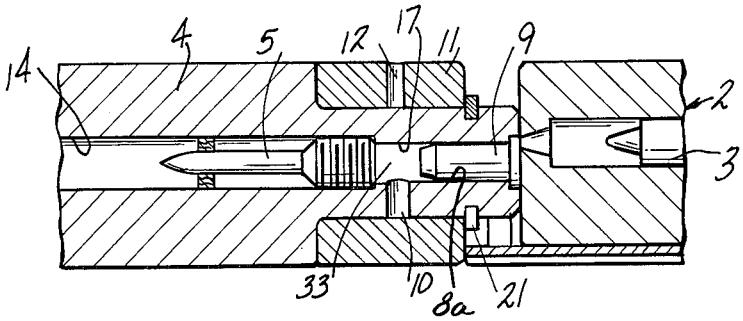
Figure 16:
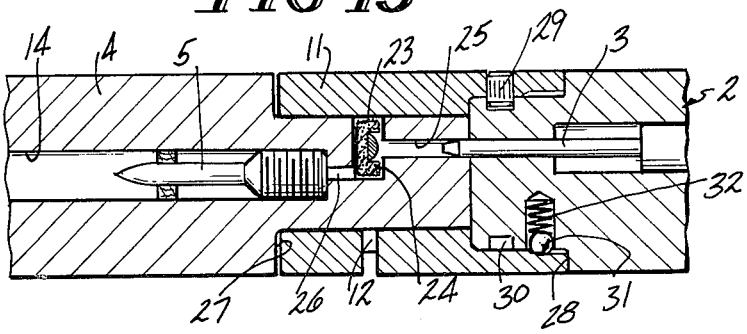
Figure 17:
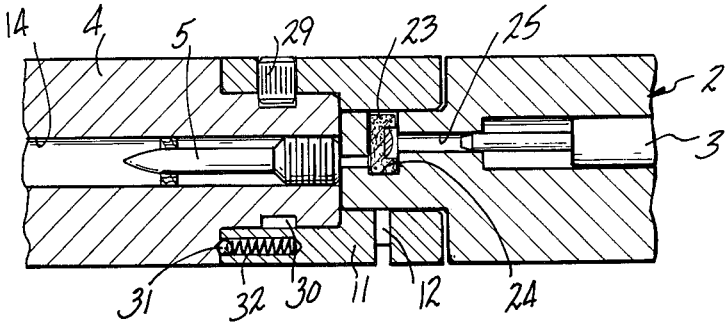
Figure 18:
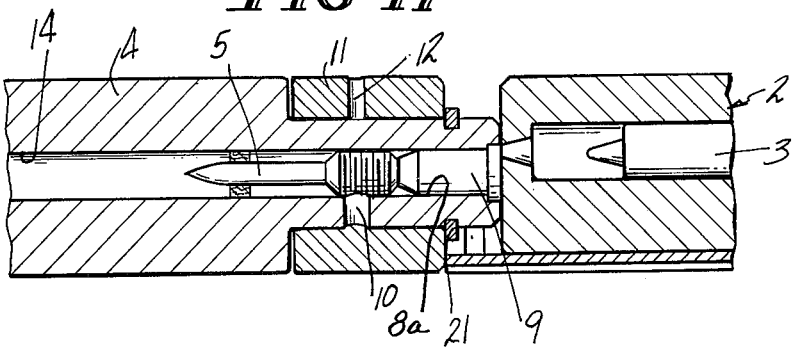
Figure 19:
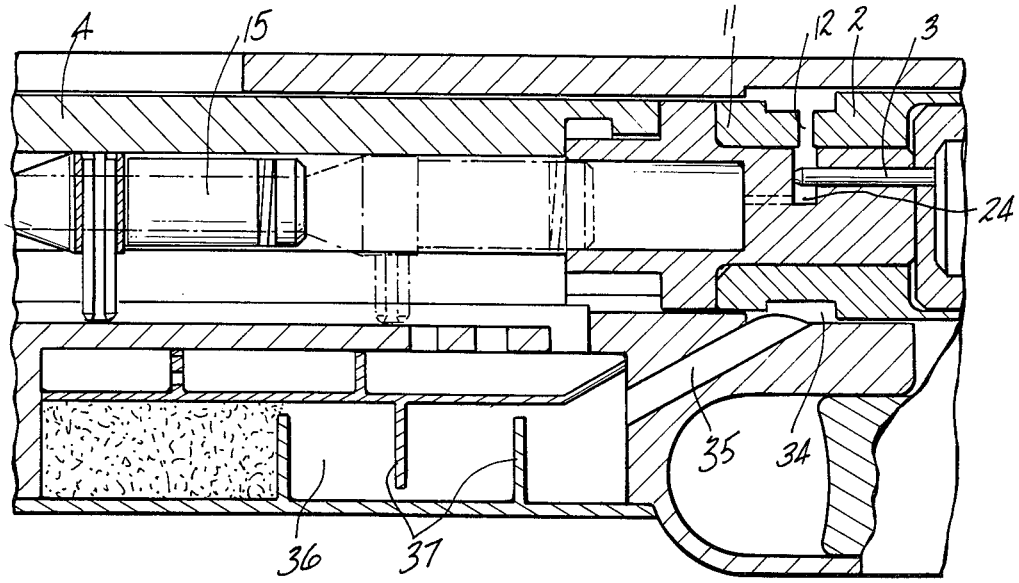
Figure 20:
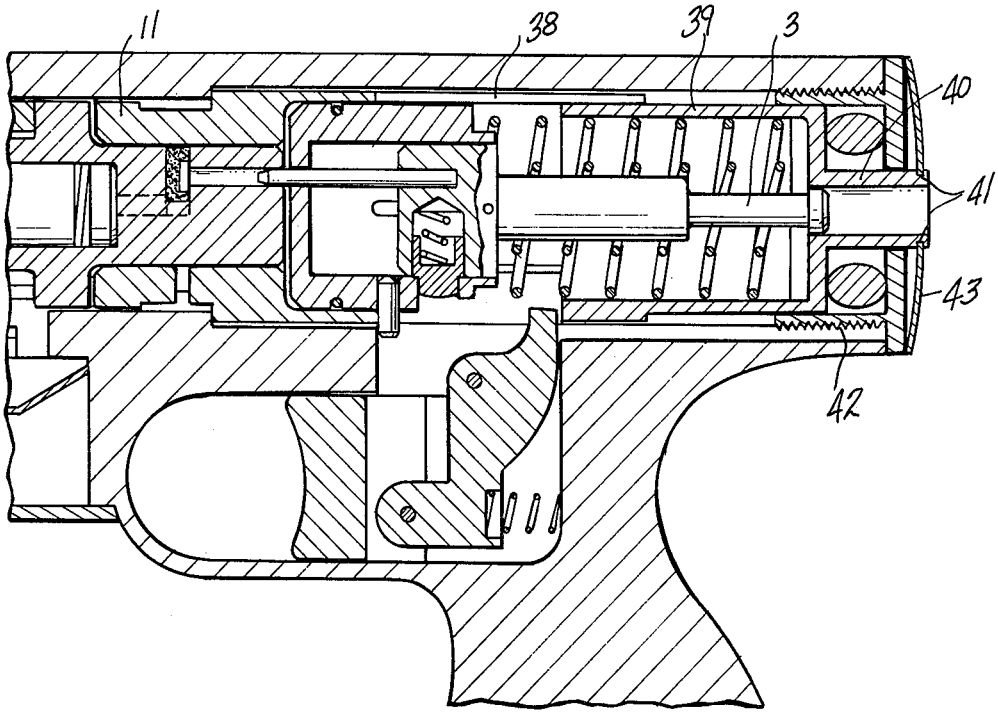
Figure 21:
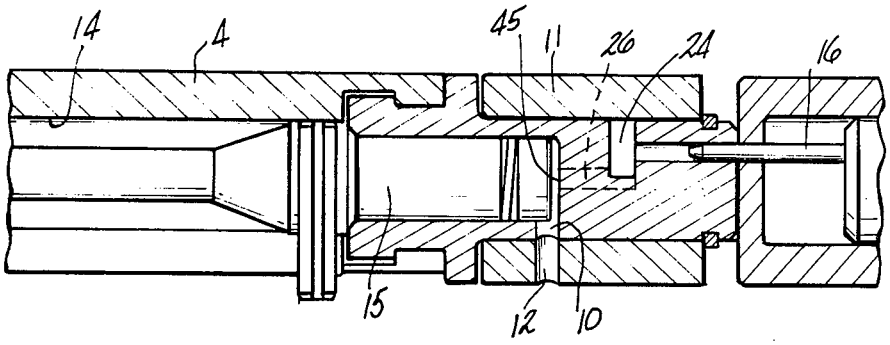
Figure 22:
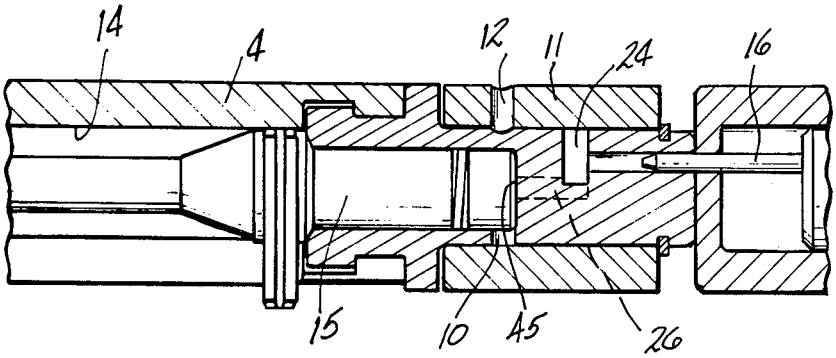

FIGS. 11 A–B–C are sectional views along the line XI–XI of FIG. 10 for three different power settings;

FIGS. 12 and 13 illustrate in longitudinal section two variants of the tool of FIG. 10;

FIGS. 14 A–B–C are respectively similar to FIGS. 11 A–B–C, but are taken along line XIV–XIV of FIG. 13; and FIG. 15 is a fragmented logitudinal sectional view of a direct firing tool using cased ammunition and having a rotary bush similar to that shown in FIG. 10;

FIG. 16 is a fragmented logitudinal sectional view similar to FIG. 13, but showing the invention used in connection with direct firing tool;

FIG. 17 is a fragmented logitudinal sectional view of a direct firing tool embodying a variation of the invention including a rotation indicator of the ball detent type;

FIG.18 is a fragmented logitudinal sectional view of a direct firing tool simlar to that shown in FIG. 15, but modified to permit insertion of the fastener into the barrel through the breech end thereof;

FIG. 19 is a fragmented logitudinal sectional view of a modified tool made in accordance with the invention wherein the power setting mechanism is combined with an exhaust chamber to provide for controlled escape of combustion gases;

FIG. 20 is a fragmented logitudinal sectional view of a modified tool made in accordance with the invention wherein the power setting adjustment may be made from the rear of the tool while the breech thereof is closed;

FIG. 21 is a fragmented logitudinal sectional view of a modified tool made in accordance with the invention wherein the power adjustment is made by acting on the low pressure chamber, the power setting being shown at its lowest value; and FIG. 22 is a view similar to FIG. 21 showing the power setting of the tool at its highest power setting.

Figure 1:
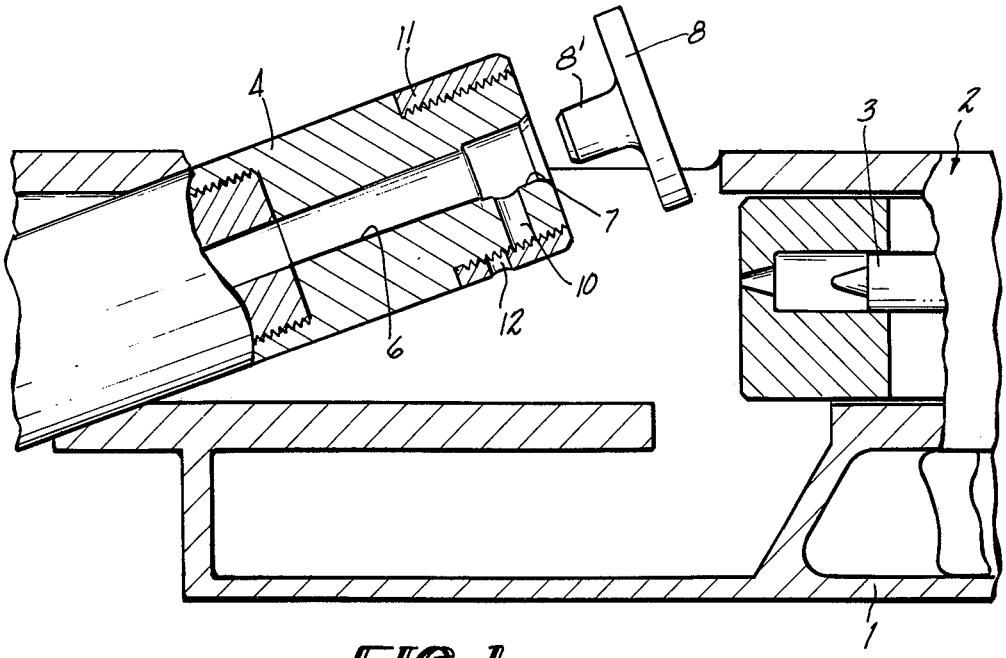
FIGS. 1 to 3 are longitudinal sections for various positions of use showing a first variant of a tool according to the invention.
Figure 3:
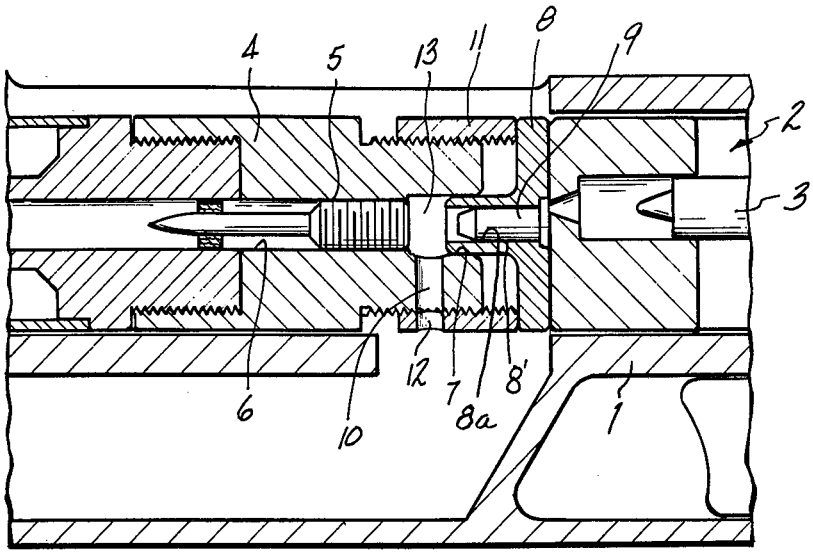
Figure 2:
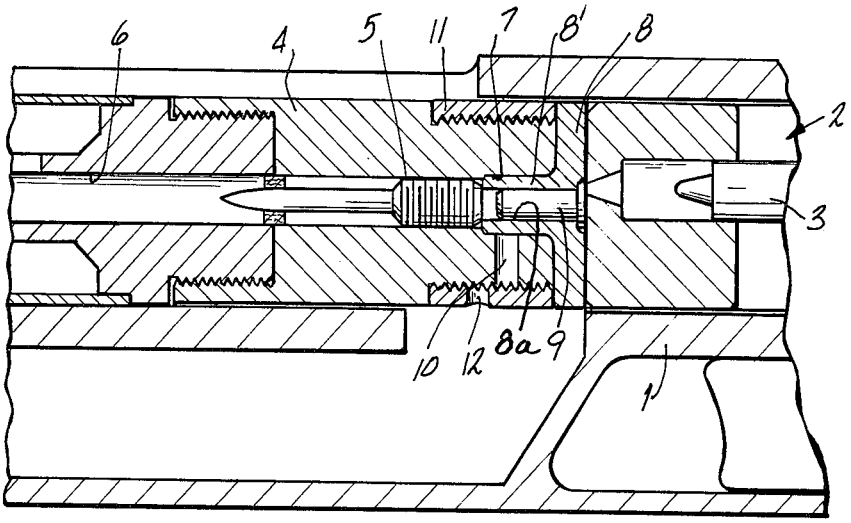

Reference should first be made to FIGS. 1 to 3 which show a direct firing tool using cased ammunition. The tool comprises a breech 1 having a percussion system 2 with a percussion striker 3. A barrel 4 is slidingly mounted and pivots relative to breech 1. This permits the loading from the rear of a fastener 5 into the channel 6 of the barrel, the channel having a larger diameter rear end 7. The tool also comprises an independent ammunition holder 8 which is intended to receive a piece of cased ammunition 9. A pusher rod (not shown) can be provided for extracting the case after combustion of the charge. The combustion chamber 8*a* comprises an axially aligned through bore in the ammunition holder 8 which also has an end 8' which penetrates the portion 7 of channel 6.

A radial duct 10 opens into portion 7 of channel 6 and a bush 11, equipped with a radial hole 12 is screwed to the rear threaded end of barrel 4. Depending on the degree to which bush 11 is screwed to barrel 4 extension 8' of ammunition holder 8 penetrates to a greater or lesser extent into portion 7 of channel 6.

When bush 11 is screwed right down onto barrel 4 (FIG. 2) the front end of extension 8' abuts directly against the base of portion 7 of channel 6, and the rear of fastener 5 is substantially in contact with the front end of extension 8, so that the expansion volume of the combustion gases is minimal (substantially zero) and the firing power is maximum.

As soon as the bush is slightly unscrewed, a volume 13 (FIG. 3) is provided between the rear end of fastener 5 and the front end of extension 8' so that the firing power decreases. After a predetermined unscrewing of bush 11 the volume of duct 10 is added to volume 13 which further decreases the firing power.

Furthermore, by angularly displacing bush 11 relative to barrel 4, hole 12 in the bush is made to correspond to a greater or lesser extent with duct 10. Hole 12 substantially issues into the open air so that the expansion volume increases until a maximum volume is reached corresponding to the position of FIG. 3, wherein the firing power is minimal.

Figure 4:
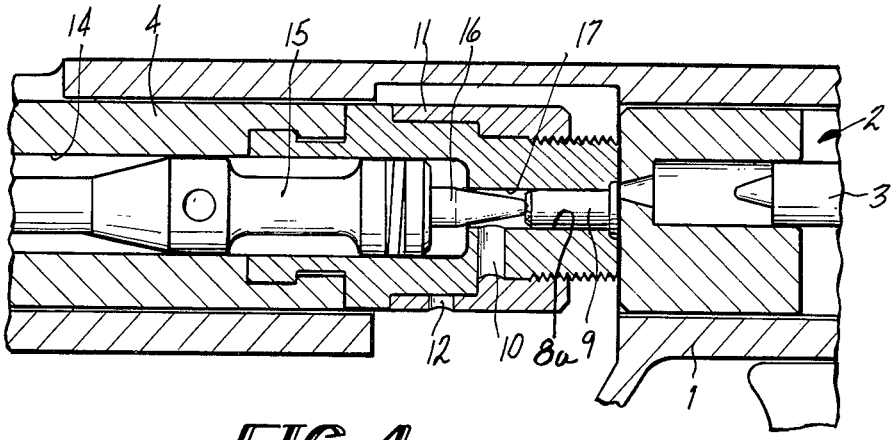
FIGS. 4 to 6 show in longitudinal section a second variant of the tool according to the invention.
Figure 5:
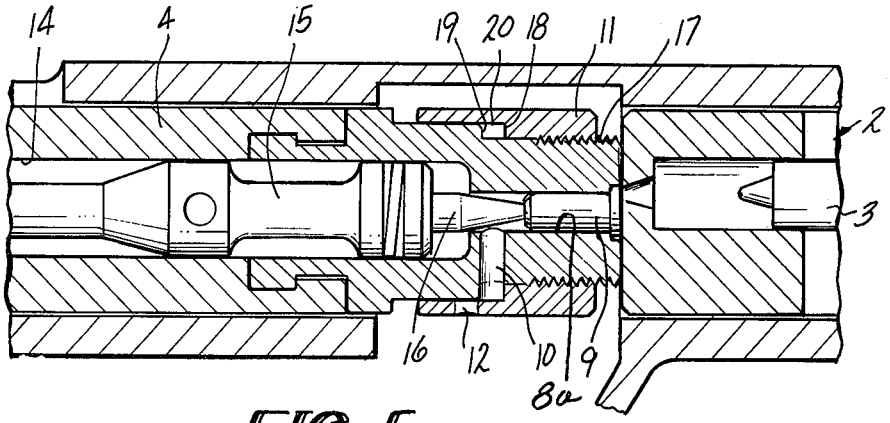
Figure 6:
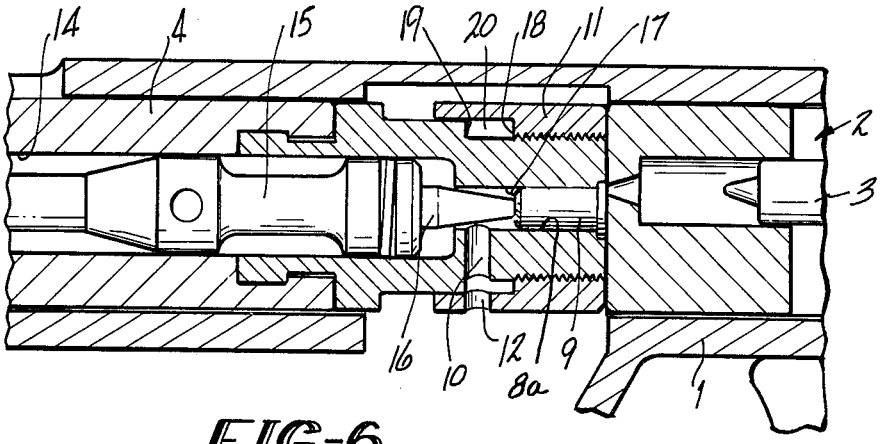

Reference should now be made to FIGS. 4 to 6 which show an indirect firing tool using cased ammunition. The same reference numerals designate the same components as hereinbefore. In this embodiment barrel 4 has an axial bore 14 in which slides a ram 15 terminated at the rear by a portion 16 which slides in a rear extension 17 of bore 14 but whose diameter is smaller than the bore. Cartridge 9 is located in combustion chamber 8*a* in extension 17 and its case is extracted after combustion and opening the gun, by the return of the ram. Portion 16 can be eliminated and the case is then extracted by means of an extractor.

A bush 11 provided with a radial hole 12 is screwed onto the rear of barrel 4 and has an inner shoulder 18 striking against an outer shoulder 19 of barrel 4. When shoulders 18 and 19 abut against one another (FIG. 4) the expansion volume of the gases, comprising the volume of duct 10, is minimal and the firing power maximum. When bush 11 is slightly unscrewed the annular volume 20 provided between shoulders 18 and 19, with which the duct 10 communicates, is added to the expansion volume and the firing power decreases (FIG. 5). After a predetermined unscrewing of bush 11 hole 12 projects more or less completely beyond shoulder 19 and the expansion volume is vented to correspondingly varying degrees. In the position of FIG. 6 the firing power is minimal.

It should be noted that in this embodiment the venting of the expansion volume takes place into annular volume 20. In the embodiment of FIGS. 1 to 3 however, the venting can only take place in one angular position of the bush, making it necessary to provide a visual indicating system, not shown, such that marks on barrel 4 and on bush 11 indicate the coincidence of the axes of duct 10 and hole 12.

Figure 7:
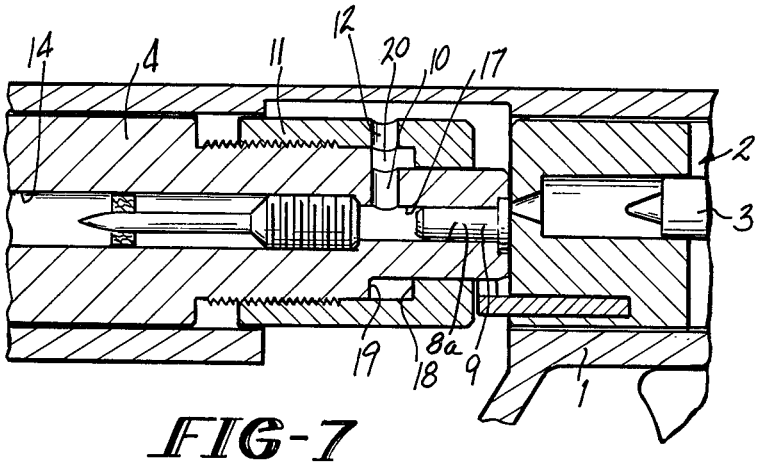
FIGS. 7 to 9 show in longitudinal section a third variant of the tool according to the invention.
Figure 8:
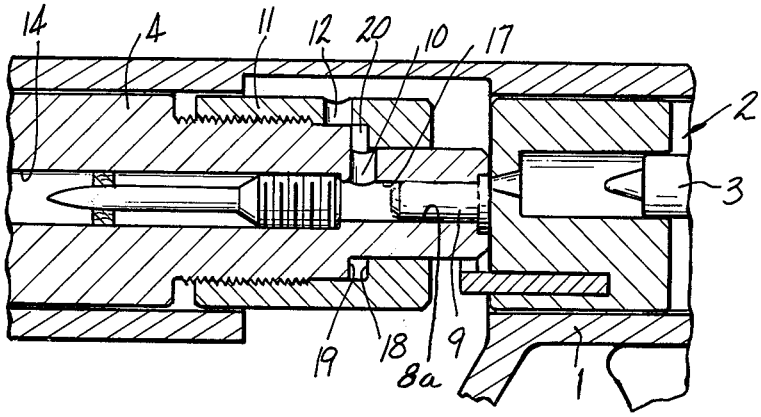
Figure 9:
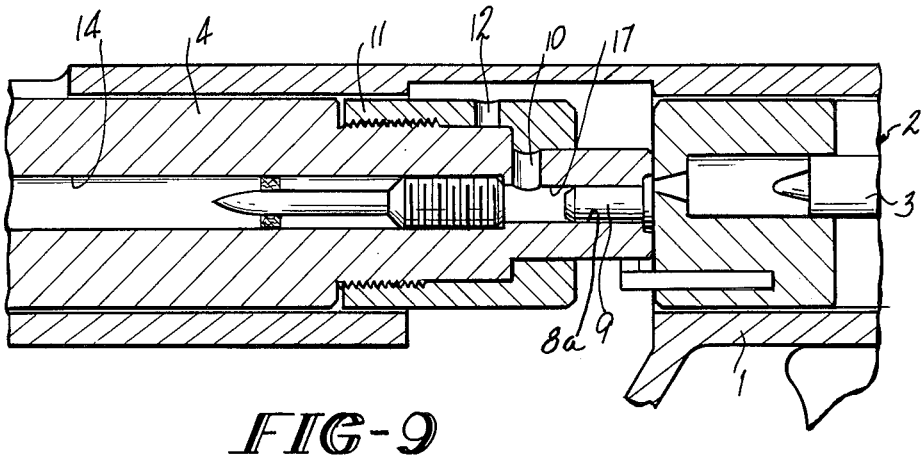

The embodiment of FIGS. 7 to 9 is similar to that of FIGS. 4 to 6, except that the tool has a direct firing action so that it has no ram. The same reference numerals designate the same components as in FIGS. 4 to 6. FIG. 7 shows the minimum power position with a maximum expansion volume and venting. FIG. 8 shows a medium power position without venting, whilst FIG. 9 shows a maximum power position with a minimum expansion volume without venting. The ammunition case is extracted by an extractor after combustion.

FIGS. 10 and 11 A, B and C shows a variant of the tool according to the invention, for a direct firing system with cased ammunition. In this variant bush 11 is no longer screwed to barrel 4 but solely rotates with no possibility of axial displacement. To this end, bush 11 is maintained against logitudinal movement with respect to the barrel 4 by a ring 21 secured to the barrel 4. Bush 11 has three radial holes 12, 12' and 12'', located in a same radial plane and having different diameters. The angular position of bush 11 relative to barrel 4 is marked by a ball 22 biased by a spring 23 and co-operating with slots provided in the tool.

In the angular position of FIG. 11-A, none of the holes 12, 12' and 12'' faces duct 10 and the firing power is maximum. In the position of FIG. 11-B the smallest diameter hole 12'' faces duct 10 and the firing power is medium. For another position, not shown, where the medium diameter 12 faces duct 10 the power is lower than in the previous case. Finally in the position of FIG. 11-C the largest diameter hole 12' faces duct 10 and the firing power is minimal.

The embodiment of FIG. 12 is identical to that of FIGS. 10 and 11 A, B and C except that ram 15 has a conical rear end 16, as in the case of FIGS. 4 to 6.

Reference should now be made to FIGS. 13 and 14 A, B and C which show an indirect firing tool using caseless ammunition. The caseless ammunition 23 is placed in a recess or combustion chamber 24 which opens through the periphery of barrel 4, and into which opens at the rear, a passage 25 for the percussion striker 3 and, at the front, a passage 26 opening onto the rear face of the ram. Bush 11 also rotates exclusively relative to barrel 4. To this end, it is located between a shoulder 27 of the barrel and a shoulder 28 of the percussion system 2. Furthermore, a stud 29 integral with bush 11 co-operates with a peripheral groove 30 of the percussion system 2. A ball 31 returned by a spring 32 co-operates with slots in bush 11 to assure its marking in the angular position.

The bush 11 can have a plurality of holes as in the case of FIGS. 10, 11 A, B and C and 12 but it needs only have a single slot 12 preferably widened towards the outside, as shown in FIG. 14 A, B and C. In the angular position of FIG. 14 A, slot 12 does not face the opening of chamber 24. The firing power is then maximum because the high pressure chamber 24 is not vented to the atmosphere. In the angular position of FIG. 14-B, slot 12 only partly communicates with chamber 24 and therefore the firing power is medium. In the position of FIG. 14-C, slot 12 completely faces chamber 24 and the firing power is minimal. There can obviously be more than three marking positions for bush 11. This embodiment can also be used with the tools of FIGS. 10 and 12.

The embodiment of FIG. 15 relates to a direct firing tool using cased ammunition having a rotary bush 11 of the same type as FIG. 10. The initial volume of chamber 33 is constant and not zero.

FIG. 16 shows a tool which is identical to that of FIG. 13, except that it is of the direct firing type.

In the tool of FIG. 17 the high pressure chamber 24 is provided in percussion system 2. The marking system of rotary bush 11, which comprises ball 31 and its spring 32, co-operates with slots provided in barrel 4.

The tool of FIG. 18 is identical to that of FIG. 15, except that the channel 14 is extended without narrowing up to the rear of the barrel, thereby permitting the introduction from the rear of the fastener.

In all cases the power setting marks can be used, particularly when a rotary bush is used, such as that of FIG. 14, so that the operator can see everything whilst using the tool.

It is also possible, with the system according to the invention, to combine the power setting with a controlled escape of the combustion gases.

For example, FIG. 19 shows a tool according to the invention after firing. In this embodiment the bush 11 has a peripheral groove 34 into which opens the radial hole 12. Groove 34 is permanently connected via a duct 35 provided in the butt with an exhaust chamber 36 equipped with baffles 37. When the hole 12 faces chamber 24 part of the combustion gases is diverted towards the exhaust chamber 36.

FIG. 20 shows an embodiment of a tool with a pivoting bush 11 according to the invention, in which the rotation of bush 11 is controlled from the rear of the device, permitting the user positioned behind the tool at the moment of firing, to set the power at the desired value whilst remaining in the working position.

To this end, bush 11 is rearwardly terminated by an arm 38 co-operating with a slot provided in a pivoting member 39. Member 39 is rearwardly extended by a tubular portion 40 serving as a guide to the percussion striker 3 and having two transverse slots 41. A cover 42 covers the rear of the tool and is maintained in place by a washer 43 having a gap whose radius permits co-operation with slots 41 of member 39. The rotation of washer 43 produces the rotation of bush 11 via member 39–40.

When caseless ammunition is used the power can be adjusted by acting on the low pressure chamber. FIGS. 21 and 22 show a power actuated tool using caseless ammunition. Duct 10 faces low pressure chamber 45 and the holes or slot 12 of bush 11 correspond. FIG. 21 corresponds to the minimum power position and FIG. 22 to the maximum power position.

Since many changes and variations of the disclosed embodiments of the invention may be made without departing from the inventive concept, it is not intended to limit the invention otherwise than as required by the appended claims.

What is claimed is:

1. In a power actuated tool of the type comprising a breech, a barrel mounted on said breech and including a longitudinal bore, a combustion chamber provided in said breech and adapted for the production of combustion gases from a piece of ammunition carried therein, a percussion mechanism in said breech operatively disposed to fire said ammunition, and an expansion chamber provided in one of said breech and said barrel and communicating between said bore of said barrel and said combustion chamber; the improvement comprising: means for varying the effective volume of said expansion chamber to adjust the operating force of the tool, said means comprising a vent provided in the sidewall of one of said chambers adapted to provide passage for a portion of said gases to the atmosphere and a bush moveably carried about the said chamber having the said vent, said bush including at least one opening adjustably alignable with said vent, whereby flow of said gases therethrough may be controlled.

2. A tool according to claim 1 wherein said bush is fixed in translation relative to said barrel and rotates about said barrel axis.

3. A tool according to claim 2, wherein said bush has at least one reference ball biased by a spring and cooperating with recesses in said breech.

4. A tool according to claim 1, wherein an independent ammunition holder is provided, supported on said barrel and abutting a free end of said bush, said combustion chamber being formed in said ammunition holder.

5. A tool according to claim 1, wherein said vent is provided in a smaller diameter rear portion of said barrel, and said bush is screwed to a larger diameter portion of said barrel and has an inner shoulder positioned so as to be able to cooperate with a shoulder provided on said barrel between said smaller diameter portion and said larger diameter portion to limit the displacement of said bush relative to said barrel.

6. A tool according to claim 1, wherein said bush is operatively connected to a rotatable control member located on said breech, whereby said bush may be displaced by rotation of said control member.

7. A tool according to claim 1, wherein said bush is formed with a plurality of holes disposed in the same radial plane, said holes having different diameters.

8. A tool according to claim 1, wherein said bush is connected to a rotatable control member located at a rear end of the tool, for concurrent rotation with said control member.

9. In a power actuated tool of the type including a barrel having a bore, a breech, a combustion chamber formed in said breech adapted for the production of combustion gases from a piece of ammunition carried therein, and a passage formed in at least one of said breech and said barrel for conducting said gases from said chamber to said bore of said barrel; the improvement comprising: means for controllably varying the operating force of the tool, said means comprising a vent provided in said passage communicating with the atmosphere and a bush moveably carried about said passage, said bush including at least one through opening adjustably alignable with said vent, whereby flow of said gases therethrough may be controlled.

10. The tool of claim 9, wherein said combustion chamber is moveable relative to said barrel and said bush engages said chamber and said barrel such that displacement of said bush displaces said chamber relative to said barrel, whereby the volume of said passage may be varied.

* * * * *